US011583067B2

(12) United States Patent
Adkins

(10) Patent No.: US 11,583,067 B2
(45) Date of Patent: Feb. 21, 2023

(54) EXTENSION ADAPTER ASSEMBLY

(71) Applicant: David Adkins, Camdenton, MO (US)

(72) Inventor: David Adkins, Camdenton, MO (US)

( * ) Notice: Subject to any disclaimer, the term of this patent is extended or adjusted under 35 U.S.C. 154(b) by 355 days.

(21) Appl. No.: 16/987,091

(22) Filed: Aug. 6, 2020

(65) Prior Publication Data

US 2022/0039546 A1 Feb. 10, 2022

(51) Int. Cl.
*A46B 17/02* (2006.01)
*B25G 3/30* (2006.01)

(52) U.S. Cl.
CPC ..... *A46B 17/02* (2013.01); *B25G 3/30* (2013.01); *A46B 2200/202* (2013.01)

(58) Field of Classification Search
CPC ..... A46B 2200/202; A46B 17/02; B25G 3/20
See application file for complete search history.

(56) References Cited

U.S. PATENT DOCUMENTS

| | | | | |
|---|---|---|---|---|
| 3,319,280 | A | 5/1967 | Trachsler | |
| 3,894,807 | A | 7/1975 | Betz, III | |
| 4,525,889 | A | 7/1985 | Dunau | |
| D556,458 | S | 12/2007 | Lanz | |
| 8,387,198 | B2 | 3/2013 | Rodriguez | |
| 9,289,895 | B1 | 3/2016 | Bauer | |
| 10,709,232 | B1 * | 7/2020 | Sagastume | A46B 15/0081 |
| 2018/0206623 | A1 * | 7/2018 | Welschoff | A46B 5/0095 |
| 2019/0365087 | A1 * | 12/2019 | Boutorine | B32B 5/26 |

* cited by examiner

*Primary Examiner* — Michael D Jennings

(57) ABSTRACT

An extension adapter assembly includes a cylinder that has a first well extending therein and a second well extending therein. The first well insertably receives an end of an extension pole and the second well insertably receives a handle of a paint brush for attaching the paint brush to the extension pole. A nut is threadably coupled to the cylinder and the paint brush extends through the second nut. A compression fitting is positioned in the nut and the compression fitting compresses against the handle of the paint brush when the nut is tightened. In this way the handle of the paint brush is inhibited from being removed from the second well.

7 Claims, 5 Drawing Sheets

EXTENSION ADAPTER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to adapter devices and more particularly pertains to a new adapter device for attaching a paint brush to an extension pole.

(2) Description of Related Art Including Information Disclosed Under 37 CFR 1.97 and 1.98

The prior art relates to adapter devices including a paint brush clamp that has a first half being pivotally coupled to a second half for attaching a paint brush to an extension pole. The prior art discloses a sleeve that receives an extension pole and which has a gasket therein for gripping a paint brush handle to attach the paint brush to the extension pole. The prior art discloses a block which has an opening for receiving a paint brush handle and a resilient spring to frictionally engage the paint brush handle for attaching the paint brush to an extension pole. The prior art discloses a sleeve that has a locking channel which receives a locking pin on a handle of a paint brush for securing the paint brush in the sleeve when the sleeve is attached to an extension pole.

BRIEF SUMMARY OF THE INVENTION

An embodiment of the disclosure meets the needs presented above by generally comprising a cylinder that has a first well extending therein and a second well extending therein. The first well insertably receives an end of an extension pole and the second well insertably receives a handle of a paint brush for attaching the paint brush to the extension pole. A nut is threadably coupled to the cylinder and the paint brush extends through the second nut. A compression fitting is positioned in the nut and the compression fitting compresses against the handle of the paint brush when the nut is tightened. In this way the handle of the paint brush is inhibited from being removed from the second well.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
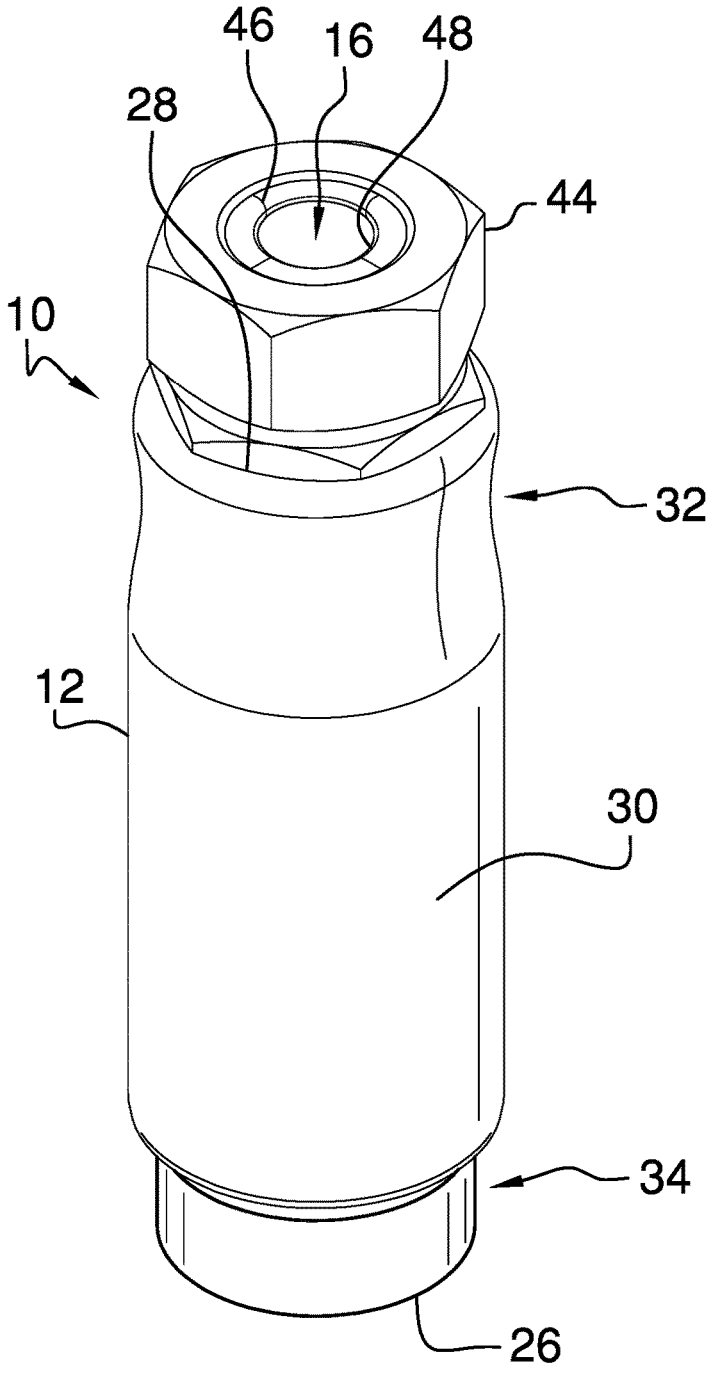
FIG. 1 is a top perspective view of an extension adapter assembly according to an embodiment of the disclosure.
Figure 2:
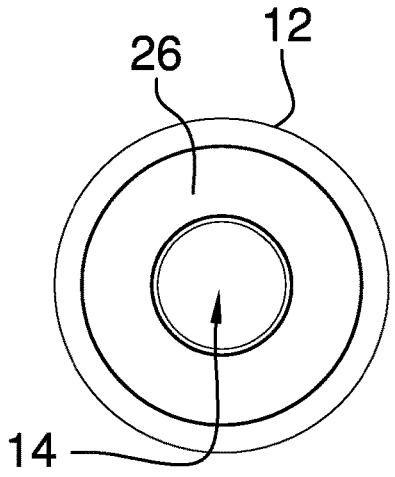
FIG. 2 is a bottom view of an embodiment of the disclosure.
Figure 3:
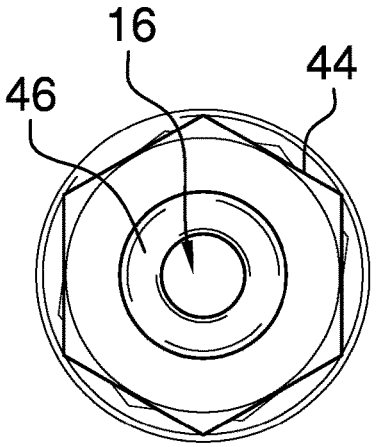
FIG. 3 is a top view of an embodiment of the disclosure.
Figure 4:
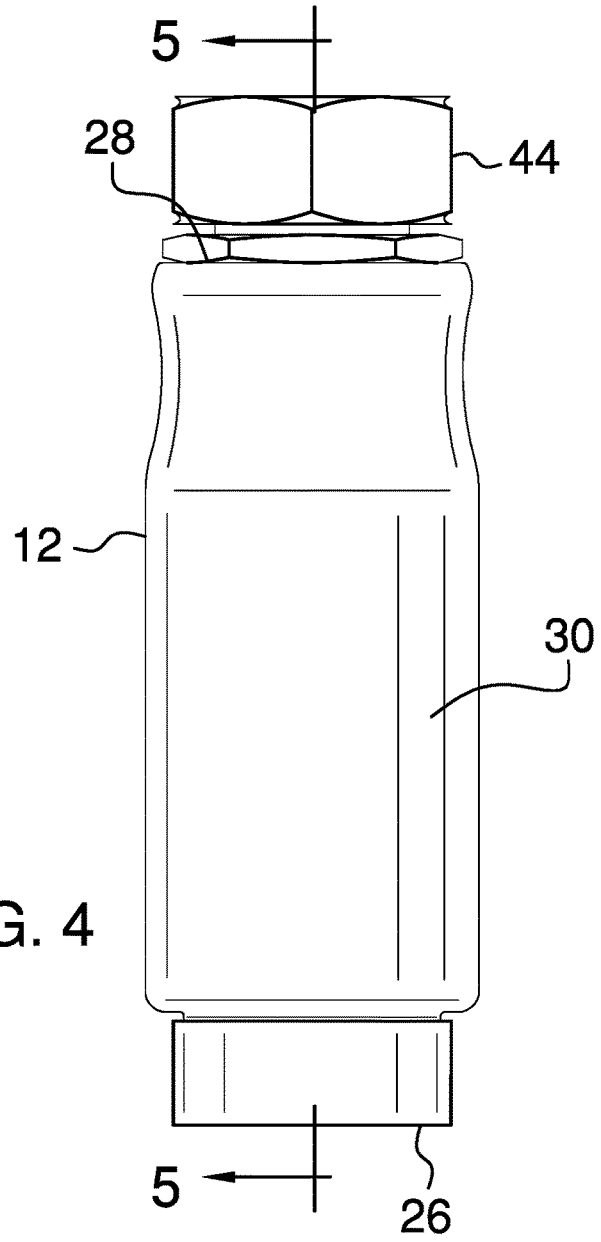
FIG. 4 is a front view of an embodiment of the disclosure.
Figure 5:
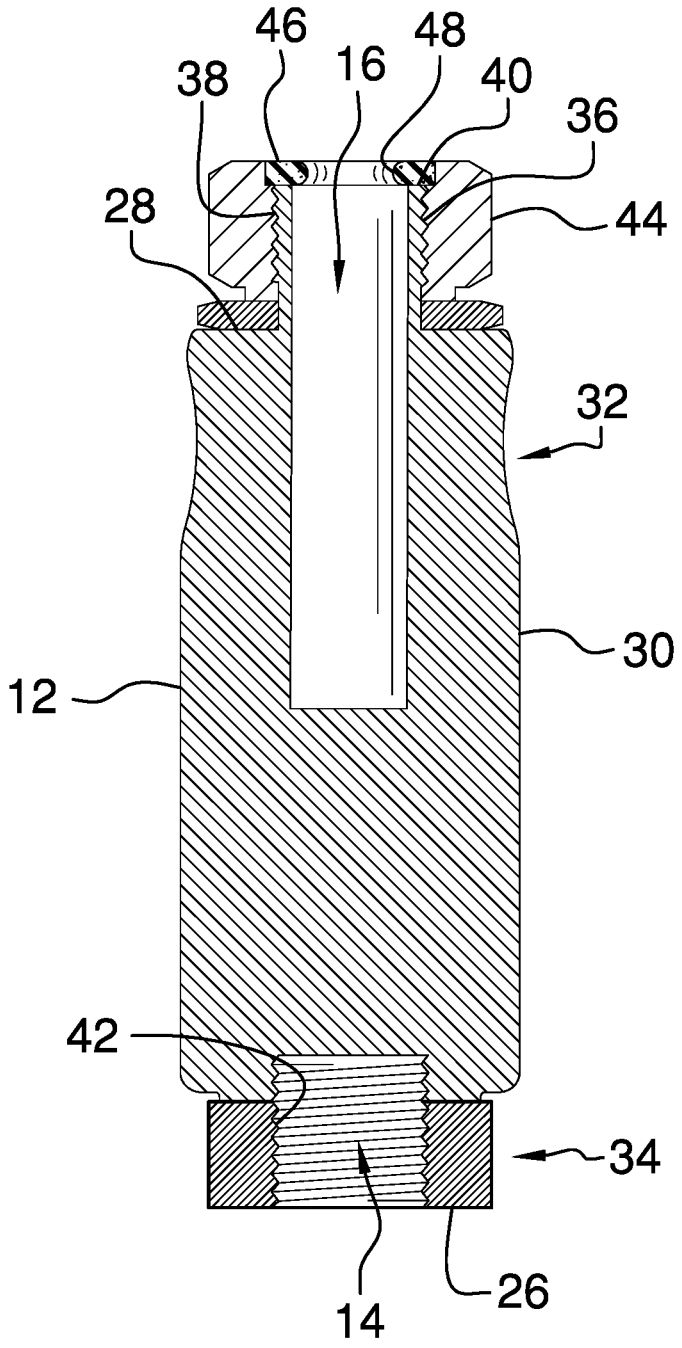
FIG. 5 is a cross sectional view taken along line 5-5 of FIG. 4 of an embodiment of the disclosure.
Figure 6:
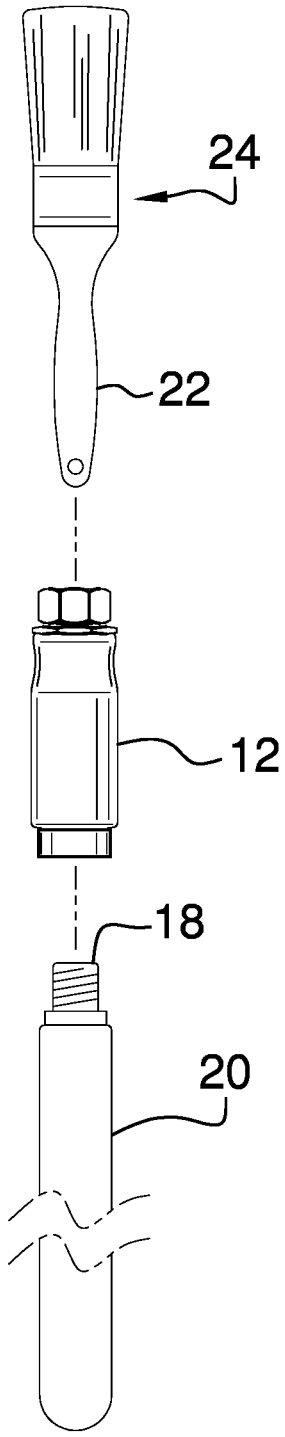
FIG. 6 is an exploded in-use view of an embodiment of the disclosure.
Figure 7:
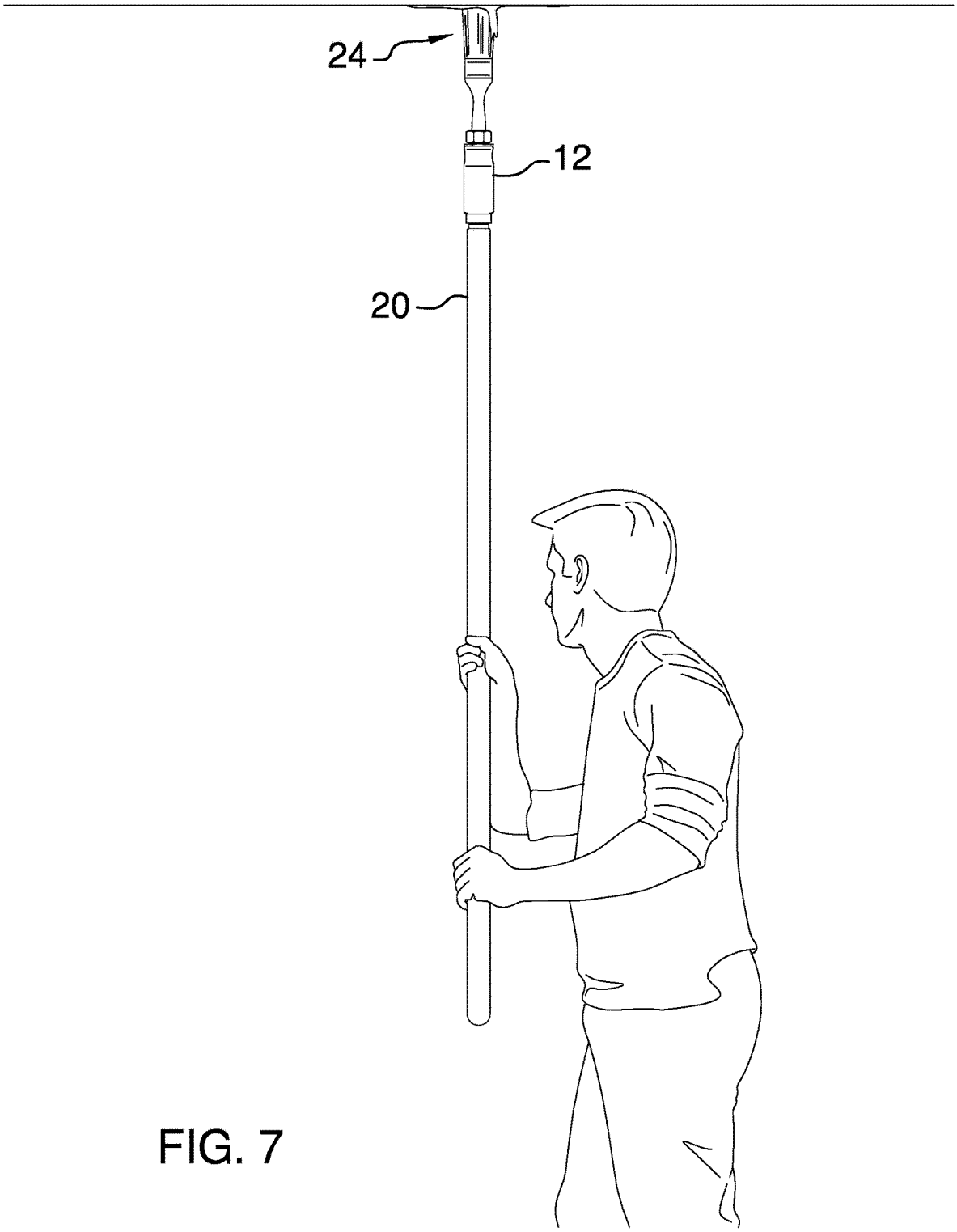
FIG. 7 is a perspective in-use view of an embodiment of the disclosure.

With reference now to the drawings, and in particular to FIGS. 1 through 7 thereof, a new adapter device embodying the principles and concepts of an embodiment of the disclosure and generally designated by the reference numeral 10 will be described.

As best illustrated in FIGS. 1 through 7, the extension adapter assembly 10 generally comprises a cylinder 12 has a first well 14 extending therein and a second well 16 extending therein. The first well 14 insertably receives an end 18 of an extension pole 20 and the second well 16 insertably receives a handle 22 of a paint brush 24. In this way the cylinder 12 can attach the paint brush 24 to the extension pole 20. The cylinder 12 has a first end 26, a second end 28 and an outer wall 30 extending therebetween, and the outer wall 30 has a concavely arcuate portion 32 extending around a full circumference of the outer wall 30. The concavely arcuate portion 32 is positioned adjacent to the second end 28 for enhancing gripping the cylinder 12.

The first well 14 extends from the first end 26 toward the second end 28. The second well 16 extends from the second end 28 toward the first end 26. The outer wall 30 may have an inset portion 34 positioned adjacent to the first end 26. Additionally, the inset portion 34 may have a diameter that is less than the diameter of the rest of the outer wall 30.

The second end 28 has a tube 36 extending outwardly therefrom, and the tube 36 extends around the second well 16. The tube 36 has an outer surface 38, the outer surface 38 is threaded and the tube 36 has a distal end 40 with respect to the second end 28. The first well 14 has a bounding surface 42 and the bounding surface 42 is threaded. Additionally, the bounding surface 42 threadably engages the end 18 of the extension pole 20.

A nut 44 is provided and the nut 44 is threadably coupled to the cylinder 12. The nut 44 surrounds the second well 16 such that the handle 22 of the paint brush 24 extends through the second nut 44. The nut 44 is tightenable against the cylinder 12 and the nut 44 is loosenable on the cylinder 12. Moreover, the nut 44 threadably engages the outer surface 38 of the tube 36. The nut 44 may be a hex nut or the like that can be manipulated with a wrench, a socket or other common hand tool.

A compression fitting 46 is positioned in the nut 44 and the handle 22 of the paint brush 24 extends through the compression fitting 46 when the handle 22 of the paint brush 24 is extended into the second well 16. The compression fitting 46 compresses against the handle 22 of the paint brush 24 when the nut 44 is tightened. In this way the handle 22 of the paint brush 24 is inhibited from being removed from the second well 16. The compression fitting 46 lies against the distal end 40 of the tube 36 and the compression fitting 46 has an inwardly facing surface 48. The inwardly facing surface 48 is compressed against the handle 22 of the paint brush 24 when the compression fitting 46 is compressed against the distal end 40 of the tube 36 when the nut 44 is tightened.

In use, the end of the extension pole 20 is threaded into the first well 14 and the handle 22 of the paint brush 24 is inserted through the compression fitting 46 into the second well 16. The nut 44 is tightened to compress the compression fitting 46 against the handle 22 of the paint brush 24. In this way the paint brush 24 can be attached to the extension pole 20 for painting areas that would otherwise be out of reach. The nut 44 is loosened to facilitate the handle 22 of the paint brush 24 to be removed from the second well 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An extension adapter assembly for mounting a paint brush on an extension pole, said assembly comprising:

a cylinder having a first well extending therein and a second well extending therein, said first well insertably receiving an end of an extension pole, said second well insertably receiving a handle of a paint brush wherein said cylinder is configured to attach the paint brush to the extension pole;

a nut being threadably coupled to said cylinder, said nut surrounding said second well such that said nut is configured for the handle of the paint brush to extend through said nut, said nut being tightenable against said cylinder, said nut being loosenable on said cylinder; and a compression fitting being positioned in said nut, said compression fitting having the handle of the paint brush extended therethrough, said compression fitting compressing against the handle of the paint brush when said nut is tightened thereby inhibiting the handle of the paint brush from being removed from said second well.

2. The assembly according to claim 1, wherein said cylinder has a first end, a second end and an outer wall extending therebetween, said outer wall having a concavely arcuate portion extending around a full circumference of said outer wall, said concavely arcuate portion being positioned adjacent to said second end for enhancing gripping said cylinder, said first well extending from said first end toward said second end, said second well extending from said second end toward said first end.

3. The assembly according to claim 2, wherein:

said second end has a tube extending outwardly therefrom, said tube extending around said second well, said tube having an outer surface, said outer surface being threaded, said tube having a distal end with respect to said second end; and said nut threadably engages said outer surface of said tube.

4. The assembly according to claim 3, wherein said compression fitting lies against said distal end of said tube, said compression fitting having an inwardly facing surface, said inwardly facing surface being compressed against the handle of the paint brush when said compression fitting is compressed against said distal end of said tube when said nut is tightened.

5. The assembly according to claim 1, wherein said first well has a bounding surface, said bounding surface being threaded, said bounding surface threadably engaging the end of the extension pole.

6. An extension adapter assembly for mounting a paint brush on an extension pole, said assembly comprising:

a cylinder having a first well extending therein and a second well extending therein, said first well insertably receiving an end of an extension pole, said second well insertably receiving a handle of a paint brush wherein said cylinder is configured to attach the paint brush to the extension pole, said cylinder having a first end, a second end and an outer wall extending therebetween, said outer wall having a concavely arcuate portion extending around a full circumference of said outer wall, said concavely arcuate portion being positioned adjacent to said second end for enhancing gripping said cylinder, said first well extending from said first end toward said second end, said second well extending from said second end toward said first end, said second end having a tube extending outwardly therefrom, said tube extending around said second well, said tube having an outer surface, said outer surface being threaded, said tube having a distal end with respect to said second end, said first well having a bounding surface, said bounding surface being threaded, said bounding surface threadably engaging the end of the extension pole;

a nut being threadably coupled to said cylinder, said nut surrounding said second well such that said nut is configured for the handle of the paint brush to extend through said second nut, said nut being tightenable against said cylinder, said nut being loosenable on said cylinder, said nut threadably engaging said outer surface of said tube; and a compression fitting being positioned in said nut, said compression fitting having the handle of the paint brush extended therethrough, said compression fitting compressing against the handle of the paint brush when said nut is tightened thereby inhibiting the handle of the paint brush from being removed from said second well, said compression fitting lying against said distal end of said tube, said compression fitting having an inwardly facing surface, said inwardly facing surface being compressed against the handle of the paint brush when said compression fitting is compressed against said distal end of said tube resulting from said nut being tightened.

7. An extension adapter system for mounting a paint brush on an extension pole, said system comprising:

a paint brush having a handle;

an extension pole having an end being threaded;

a cylinder having a first well extending therein and a second well extending therein, said first well insertably receiving said end of said extension pole, said second well insertably receiving said handle of said paint brush to attach said paint brush to said extension pole, said cylinder having a first end, a second end and an outer wall extending therebetween, said outer wall having a concavely arcuate portion extending around a full circumference of said outer wall, said concavely arcuate portion being positioned adjacent to said second end for enhancing gripping said cylinder, said first well extending from said first end toward said second end, said second well extending from said second end toward said first end, said second end having a tube extending outwardly therefrom, said tube extending around said second well, said tube having an outer surface, said outer surface being threaded, said tube having a distal end with respect to said second end, said first well having a bounding surface, said bounding surface being threaded, said bounding surface threadably engaging said end of said extension pole;

a nut being threadably coupled to said cylinder, said nut surrounding said second well such that said handle of said paint brush extends through said second nut, said nut being tightenable against said cylinder, said nut being loosenable on said cylinder, said nut threadably engaging said outer surface of said tube; and a compression fitting being positioned in said nut, said compression fitting having said handle of said paint brush extended therethrough, said compression fitting compressing against said handle of said paint brush when said nut is tightened thereby inhibiting said handle of said paint brush from being removed from said second well, said compression fitting lying against said distal end of said tube, said compression fitting having an inwardly facing surface, said inwardly facing surface being compressed against said handle of said paint brush when said compression fitting is compressed against said distal end of said tube resulting from said nut being tightened.

* * * * *